United States Patent [19]

Duffield

[11] 3,970,222

[45] July 20, 1976

[54] APPARATUS AND METHOD FOR INITIATING FORMATION OF A FILAMENT OF COATING LIQUID

[75] Inventor: Peter Leonard Duffield, Chillicothe, Ohio

[73] Assignee: The Mead Corporation, Dayton, Ohio

[22] Filed: Aug. 4, 1972

[21] Appl. No.: 277,997

[52] U.S. Cl. ..... 222/148; 222/420; 346/75

[51] Int. Cl.[2] ..... B65D 83/14

[58] Field of Search ..... 222/148, 189, 330, 420, 222/394; 346/75, 140

[56] References Cited

UNITED STATES PATENTS

| | | | |
|---|---|---|---|
| 2,761,588 | 9/1956 | Shields | 222/148 |
| 3,379,477 | 4/1968 | Beckmeyer | 222/189 X |
| 3,560,641 | 2/1971 | Taylor et al. | 346/75 X |
| 3,661,304 | 5/1972 | Martinez et al. | 222/394 |

*Primary Examiner*—Drayton E. Hoffman
*Assistant Examiner*—Joseph J. Rolla
*Attorney, Agent, or Firm*—Biebel, French & Nauman

[57] ABSTRACT

There is disclosed a jet drop coating system comprising a series of orifices in an orifice plate, and an apparatus for initiating a clean flow of coating liquid through the orifices. There is a fluid supply passage leading to the orifices and this passage is initially filled with air at atmospheric pressure. The system is started up by admitting coating liquid into the passage at a relatively high rate. The pressure of the liquid is in excess of the operating pressure required for clean flowing streams through the orifices. When the liquid enters the fluid supply passage it initially drops to atmospheric pressure. As it continues to flow into the passage, it sweeps the air ahead of it causing some of the air to flow out of the orifices. However, the orifices provide sufficient restriction that the air cannot escape as fast as it is being displaced by the incoming liquid. Consequently the air trapped within the fluid supply passage becomes compressed. This in turn begins raising the pressure of the coating liquid within the fluid supply passage. The compression continues until the liquid reaches the first orifice at which time the pressure within the passage is in excess of the required start up pressure. The liquid therefrom flows through the first orifice and all the other orifices in a clean fashion and forms free flowing filaments without any blobbing.

6 Claims, 5 Drawing Figures

APPARATUS AND METHOD FOR INITIATING FORMATION OF A FILAMENT OF COATING LIQUID

BACKGROUND OF THE INVENTION

U.S. Pat. Nos. 3,560,641, 3,586,907 and 3,661,304 are directed to noncontacting coating systems wherein a liquid coating material, such as ink, is pumped under pressure to a manifold communicating with a series of small diameter orifices. As the coating material is ejected through the orifices under pressure, it forms fine filaments of coating material which break down into series of discrete drops. At the point where the drops break from the filaments they pass through charging rings which, depending upon the pattern of coating material desired on a receiving member conveyed beneath the drop generator, either charge or do not charge each individual drop of coating material.

An electrostatic deflecting field is set up downstream of the charge rings and all drops which receive a charge from the charge rings are deflected from their trajectory by the deflecting field. A catcher is also associated with the system to catch those drops which it is desired to prevent from reaching the receiving member. In this way it is seen, a pattern coating, such as printing, is applied to the receiving member.

In the operation of a drop generator of this type, it will be apparent that it takes some discrete pressure, hereinafter termed the operating pressure, to produce a filament of sufficient velocity to overcome forces, such as surface tension forces, tending to retard flow of the coating material through the orifices.

If the flow of coating material to the drop generator is commenced by merely opening a supply line to the manifold, it will be apparent that the pressure build up in the drop generator from zero to the operating pressure will occur over a finite time period.

During this period, when the pressure acting on the coating material has not yet reached operating pressure, a free jet will not be produced, but instead, a pendulous mass of coating material will collect at each orifice which weeps liquid coating material therefrom. As the pressure acting on the coating material increases a jet will eventually be produced inside the mass of liquid and finally break from the mass in an uncontrolled manner, only stabilizing after the excess liquid at the orifice has been drawn away by entrainment in the jet.

Obviously this will result, not only in a more lengthy start up procedure, but also in spattering of the coating and the collection of coating material on the components of the generator. Since the coating material is electrically conductive this can result in shorting of the various electrical components, such as the charge rings and deflecting field electrodes. Additionally, the evaporation of the coating material will leave a residue on the components of the drop generator which will eventually affect its operation.

SUMMARY OF THE INVENTION

In method and apparatus in accordance with the present invention the coating material does not contact the filament forming orifices until the pressure necessary to form a free filament of coating material has been reached in the manifold. This is accomplished by self pressurizing the manifold, to a pressure at least equal to or preferably substantially above the operating pressure required for production of a free standing filament of coating material. Self pressurizing of the manifold is accomplished by providing coating material to the manifold at a rate faster than the rate of escape of air through the orifices. A compression chamber is provided to enable completion of the required pressurization prior to arrival of the coating material at any of the orifices. Thereafter, the coating material arrives at each of the orifices at or above operating pressure and immediately forms a free standing filament issuing from the orifice which in turn breaks up into a series of discrete drops. By this method the collection of pendulous masses of coating material at the orifice and the contamination of the generator components is substantially avoided.

DESCRIPTION OF THE PREFERRED EMBODIMENTS

Figure 1:
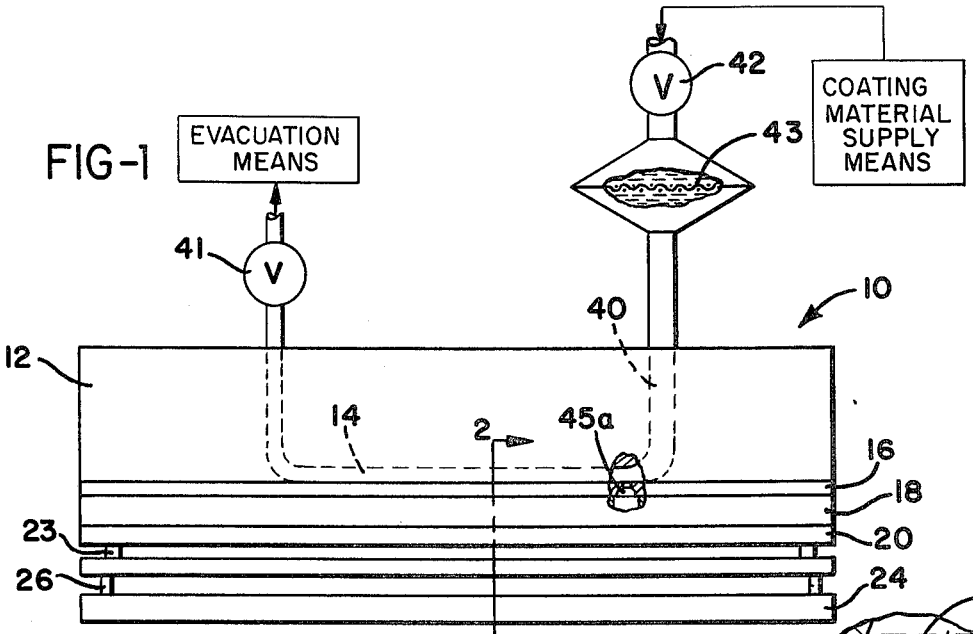
FIG. 1 is a somewhat schematic illustration of a drop generator in accordance with the present invention.
Figure 2:
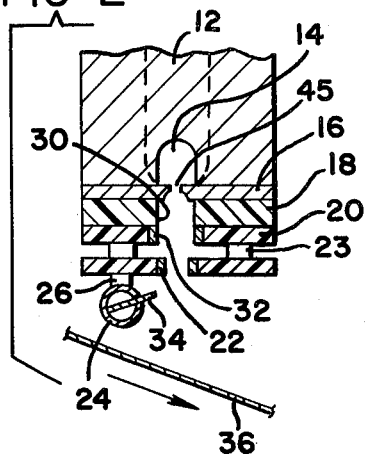
FIG. 2 is a cross sectional view taken on line 2—2 of FIG. 1.

As seen in FIGS. 1 and 2 of the drawings, a drop generator 10 in accordance with the present invention may include manifold 12 having a chamber 14 formed therein. Mounted beneath the manifold 12 is an orifice plate 16, a spacer plate 18, a charge ring plate 20, a pair of deflecting electrodes 22 attached to the charge ring plate, as at 23, and a catcher 24 spaced from the electrodes by mounting means 26.

Coating material supplied to the chamber 14 will be ejected through the orifices 45 to form fine filaments which break up into discrete drops of coating material under the action of a stimulator (not shown). It is desirable that if a charge is to be applied to a particular drop it be applied at approximately the point at which the drops break from the filaments. Thus, the spacer plate 18, having a series of openings 30 formed therethrough, spaces the charge ring plate 20 at the proper distance from the orifice plate 16 such that the charge rings 32 charge each of the drops of coating material just as they break from their respective filaments of coating material.

Thereafter, the electrodes 22 deflect all charged drops toward the blade 34 of the catcher 24 while uncharged drops are allowed to impinge on a receiving member 36 conveyed in any convenient manner past the drop generator, as indicated by the arrow in FIG. 2 of the drawings. The above description is merely for purposes of background and for a more detailed description reference may be had to the two above noted U.S. Pat. Nos. 3,560,641 and 3,586,907.

With regard to the present invention, it will be seen that if the supply of coating material to the chamber 14 is commenced by merely opening a valve from a source coating material, it will take some finite time interval until the pressure in the chamber 14 has built up to operating pressure, that is the pressure at which the coating material will overcome forces, such as surface tension forces, tending to prevent its being ejected from the orifices as free standing jets.

Figure 5:
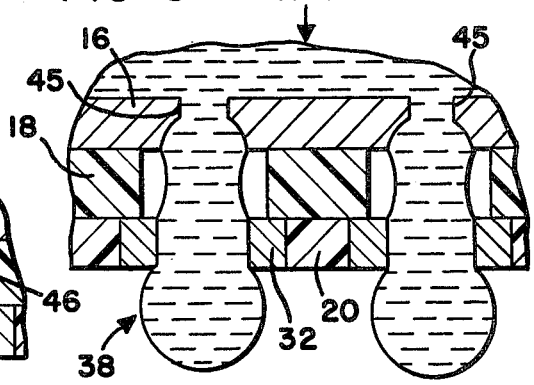
FIG-5 PRIOR ART
FIG. 5 is an enlarged cross sectional view showing the formation of coating material accumulations that result when pressure is allowed to build up gradually at the orifices.

Thus, until pressure builds up to operating pressure the coating material will tend to form pendulous masses, as indicated at 38 in FIG. 5 of the drawings, which weeps coating material downwardly, contaminating other components of the generator, such as the charge rings 32. To avoid this, chamber 14 is prepressurized by an incoming rush of coating material.

Pressurization is accomplished by closing valve 41 and opening valve 42 to admit coating material 44 into the system. (Valve 41 leads to a vacuum line which is used for shut-down and cleaning of the system). After passage through valve 42, coating material 44 flows through screen 43 for removal of any particulate material entrapped therein. After passing through screen 43, coating material 44 flows into compression chamber 40 sweeping entrapped air ahead of it.

It will be appreciated that the air within chamber 14 is not entirely trapped, because of the escape passages provided by orifices 45. It will be further appreciated that the rate at which air escapes through orifices 45 depends upon the total area of all orifices within orifice plate 16 and also upon the pressure of the air within chamber 14. Initially chamber 14 is at atmospheric pressure so that no air flows out through orifices 45. However, as coating material 44 rushes into compression chamber 40, the air ahead of it begins to compress. This compression raises the pressure of the air in chambers 40 and 14 to a level above atmospheric pressure so that escapement of air through orifices 45 begins. Orifices 45 are quite small however (typically 1 to 2 mils) and therefore the air cannot escape as fast as it is being displaced by the incoming coating material. This means that the pressure of the air within the chamber 14 continues to rise.

Figure 3:
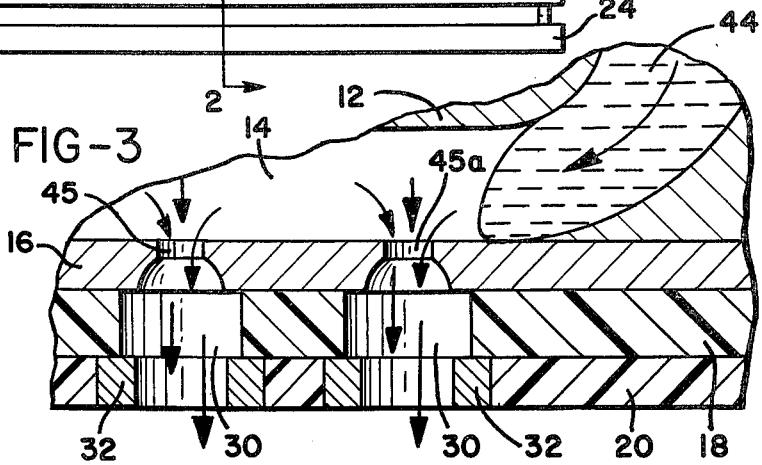
FIG. 3 is an enlarged cross sectional view of the entry end of the orifice plate just prior to the arrival of coating material.
Figure 4:
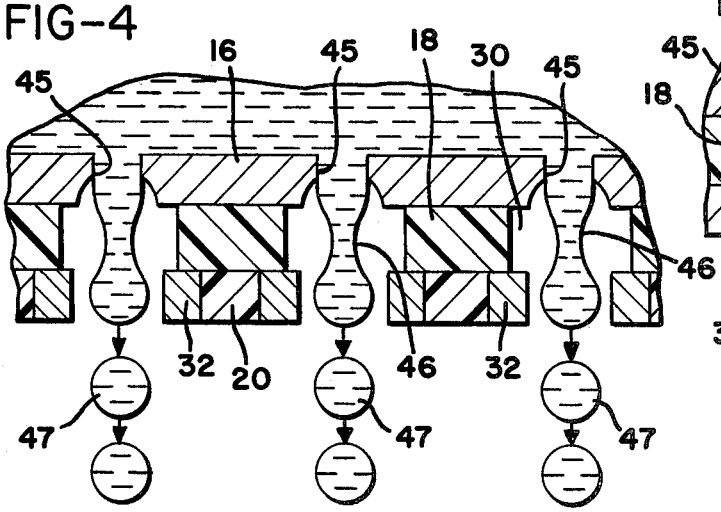
FIG. 4 is an enlarged cross sectional view showing the formation of filaments and drops of coating material in accordance with the present invention.

In accordance with the practice of this invention coating material 44 is admitted into chamber 40 at a fast enough rate to produce pressurization of the air within chamber 14 to a pressure higher than operating pressure. Furthermore, chamber 40 is sufficiently large to enable pressurization prior to arrival of coating material 44 at the first orifice 45*a* (see FIG. 3). Since the air in chamber 14 achieves a pressure greater than operating pressure prior to arrival of the coating material at orifice 45*a*, the coating material within the leading surface of the incoming liquid stream likewise has a pressure greater than operating pressure. This means that when the coating material reaches orifice 45*a* it flows cleanly therethrough without blobbing on the exit side of orifice plate 16. Immediately thereafter it forms into a filament 46 and then breaks up into drops 47. Meanwhile, coating material 44 continues to sweep across orifice plate 16 reaching other orifices and similarly creating clean flowing jets.

In order for pressurization to occur in accordance with this invention, it is necessary that two things be observed. First, coating fluid 44 must be supplied to the system fast enough to replace escaping air and yet accomplish pressurization. Secondly, the volume of compression chamber 40 must be large enough to enable the required pressurization prior to arrival of coating fluid at the first orifice 45*a*. The following analysis explains these requirements in more detail.

Assume that the entire fluid supply system including manifold 14 and compression chamber 40 has a volume $V_o$. Then at any time t after initiation of startup, the volume of air within the system is given by the equation.

$$V_A = V_o - V_L$$

where $V_L$ is the volume occupied by the onrushing liquid coating material. Now if air escapes through the orifices during startup at a volume rate $Q_A$ and the coating fluid enters at a rate $Q_L$, then one may write the initial and final equations of state and find that the air pressure in the manifold at any time t is given by the equation.

$$p = \frac{p_o V_o}{V_o - \int_o^t (Q_L - Q_A)dt}$$

where $p_o$ is the initial air pressure within the manifold. $p_o$ is also equal to atmospheric pressure outside drop generator 10. $Q_L$ is nearly constant, but will decrease slightly with time.

To achieve blob-free startup, $p$ must be at least equal to some minimum operating pressure $p_s$ when the coating material reaches the first orifice. This pressure $p_s$ is hereinafter referred to as the liquid jet formation pressure. Thus the coating material enters at some liquid pressure $P_L$ to meet air at pressure $p_o$, whereupon the coating material fills compression chamber 40 while compressing the air ahead of it. The volume $V_c$ of compression chamber 40 must be sufficiently large to enable compression of the air from pressure $p_o$ to pressure $p_s$ while a portion of the air is escaping out the orifices.

The volume requirement for chamber 40 may be determined by letting $V_L = V_c$ and $p = p_s$ in the above expression, ignoring the slight change in $Q_L$, and assuming that $Q_A$ varies linearly with time so that $$p_s = \frac{p_o V_o}{V_o - Q_L t + \bar{Q}_A t}$$

where $\bar{Q}_A$ is the average value of $Q_A$ between time $o$ and time $t$.

Rearranging the above equation and substituting, it may be seen that $$p_s = \frac{p_o}{1 - \left(\frac{1 - \bar{Q}_A}{Q_L}\right) \frac{V_c}{V_o}}$$

which gives $$V_c \geqslant \left(\frac{1 - \frac{p_o}{p_s}}{1 - \frac{\bar{Q}_A}{Q_L}}\right) V_o$$

or in terms of the manifold volume, $V_m$ $$V_c \geqslant \left(\frac{1 - \frac{p_o}{p_s}}{\frac{p_o}{p_s} - \frac{\bar{Q}_A}{Q_L}}\right) V_m$$

where $V_o = V_m + V_c$ and the only unknown quantity is $\bar{Q}_A$.

In general $Q_A$ is given by the expression $$Q_A = A_j \sqrt{\frac{2(p-p_o)}{\rho}}$$

where $A_j$ is the total area of all orifices, and $\rho$ is the density of air at pressure $p$. Thus for linearly increasing air pressure from pressure $p_o$ to pressure $p_s$:

$$\overline{Q}_A = A_j \sqrt{\frac{(p_s-p_o)}{2\rho_s}}$$

where $\rho_s$ now denotes the value of $\rho$ when $p = p_s$.

Then substituting for $\overline{Q}_A$ in the expression for $V_c$:

$$V_c \geqslant \left( \frac{1-\frac{p_o}{p_s}}{\frac{p_o}{p_s} - \frac{A_j}{Q_L}\sqrt{\frac{(p_s-p_o)}{2\rho_s}}} \right) V_m$$

which means that compression chamber 40 must occupy a volume which depends in part upon the rate of coating material supply, $Q_L$.

$Q_L$ has a minimum allowable value which may be determined by noting that coating material must enter the system at a rate at least fast enough to replace escaping air when $p$ reaches $p_s$. Thus $$Q_L \geqslant A_j \sqrt{\frac{2(p_s-p_o)}{\rho_s}}$$

In general $Q_L$ is a function of the supply pressure and the pressure drops through the system. For the embodiment shown in FIG. 1, the most significant pressure drop is across screen 43. This drop may be minimized by increasing the open area of the screen. However, system filtering requirements limit screen openings to a maximum size quite a bit smaller than the size of orifices 45, so that screen open area may be gained most easily by building screen 43 oversize as shown. Preferably screen 43 should be made quite a bit oversize so as to maximize $Q_L$ and thereby reduce the volume requirement for compression chamber 40.

In line with the above, a screen having an open area of $0.015 ft^2$ and a discharge coefficient of about 0.6 will provide coating fluid at a rate of about $0.43 ft^3/sec$ and at a pressure drop of about 15 psi. Using typical values of 15 psia for $p_o$ and 30 psia for $p_s$ and an orifice plate comprising 625 2 mil orifices, the above equation for $V_c$ shows that blob-free startup may be achieved if $V_c \geqslant 1.7\ V_m$.

While the methods and forms of apparatus herein described constitute preferred embodiments of the invention, it is to be understood that the invention is not limited to these precise methods and forms of apparatus, and that changes may be made therein without departing from the scope of the invention.

What is claimed is:

1. In a jet drop coating system comprising a coating head provided with a plurality of orifices and a manifold for delivery of liquid coating material to said orifices, improved coating material supply apparatus comprising:

a. means for supplying said coated material at a pressure greater than that required for liquid jet formation at the exits of said orifices and at a volume rate greater than the rate of escape of air through all of said orifices at said liquid jet formation pressure, and b. a compression chamber between said supply means and said manifold, said compression chamber having sufficient volume to enable incoming coating material to pressurize said manifold from atmospheric pressure to said liquid jet formation pressure while air is escaping from said orifices and prior to arrival of said coating material at any of said orifices.

2. Apparatus according to claim 1 and further comprising a filter screen at the interface between said supply means and said compression chamber.

3. Apparatus according to claim 1, said compression chamber having a volume at least 1.7 times as great as the volume of said manifold.

4. Apparatus according to claim 1 and further comprising means for terminating the flow of said coating material to said compression chamber and means for evacuating coating material from said compression chamber and said manifold following said termination.

5. Apparatus for supplying liquid coating material to a manifold for a jet drop coating system comprising:

a. means for supplying said coating material at a pressure greater than that required for liquid jet formation at the exits of the jet forming orifices of said system and at a volume rate at least as great as $$A_j \sqrt{\frac{2(p_s-p_o)}{\rho_s}}$$

where:

$A_j$ = the total area of all orifices $p_s$ = pressure required for liquid jet formation $p_o$ = initial air pressure in the manifold $\rho_s$ = density of air in the manifold when at pressure $p_s$ and b. a compression chamber between said supply means and said manifold, said compression chamber having a volume at least as great as $$V_m \left( \frac{1-\frac{p_o}{p_s}}{\frac{p_o}{p_s} - \frac{A_j}{Q_L}\sqrt{\frac{(p_s-p_o)}{2\rho_s}}} \right)$$

where:

$V_m$ = volume of said manifold $Q_L$ = coating liquid flow rate.

6. In a jet drop coating apparatus wherein a coating liquid is supplied to an orifice for discharge therefrom as a liquid jet and wherein the passage leading to said orifice is initially filled with air at atmospheric pressure, the method of initiating flow of coating liquid to said orifice comprising the steps of providing a supply of said coating liquid at a pressure in excess of the minimum liquid jet formation pressure, admitting said coating liquid at a relatively constant volume rate from said supply into said passage, confining the air within said passage during said liquid admission whereby the air is compressed by the liquid to a pressure greater than said minimum jet formation pressure prior to arrival of liquid at said orifice, and continuing to admit coating liquid from said supply into said passage at said volume rate.

* * * * *